US005572843A

United States Patent [19]

Jordan

[11] Patent Number: 5,572,843

[45] Date of Patent: Nov. 12, 1996

[54] FASTENING STRIP FOR SHEET ROOFING SYSTEMS

[75] Inventor: Franklin F. Jordan, Oakville, Canada

[73] Assignees: Jordan, Toronto; Kornelow, Oakville

[21] Appl. No.: 273,681

[22] Filed: Jul. 12, 1994

[51] Int. Cl.[6] ..... E04B 5/00

[52] U.S. Cl. ..... 52/410; 52/395; 52/520; 52/746.11; 52/718.04

[58] Field of Search ..... 52/410, 718.04, 52/718.05, 393, 394, 395, 408, 519, 520, 746.11, 748.1

[56] References Cited

U.S. PATENT DOCUMENTS

| | | | |
|---|---|---|---|
| 3,984,958 | 10/1976 | Murray | 52/410 X |
| 4,321,780 | 3/1982 | Hooper et al. | 52/718.05 X |
| 4,400,922 | 8/1983 | Boyer | 52/395 X |
| 4,519,175 | 5/1985 | Resan | 52/746.11 X |
| 4,543,758 | 10/1985 | Lane | 52/410 |
| 5,251,416 | 10/1993 | White | 52/410 |
| 5,287,670 | 2/1994 | Funaki | 52/520 X |

*Primary Examiner*—Carl D. Friedman
*Assistant Examiner*—W. Glenn Edwards
*Attorney, Agent, or Firm*—Jane Parsons

[57] ABSTRACT

A roof cladding system includes flexible, waterproof, plastics material sheet and feature strips each comprising a base strip and an interchangeable cap. Caps having different profiles may be used to provide different ornamentation. The base strip is flexible to the sheet and has upturned elongate lips acting as latches for downwardly projecting in-turned flanges of the cap.

7 Claims, 3 Drawing Sheets

FASTENING STRIP FOR SHEET ROOFING SYSTEMS

BACKGROUND OF THE INVENTION

1. Field of the Invention

This invention relates to sheet roofing systems.

2. Description of Prior Art

Traditionally many roofs, especially roofs of large buildings such as arenas, barns, industrial warehouses and the like, have been made from sheet metal material. Sheet metals tend to be expensive and are difficult to handle especially in high winds. Joins between the sheets have needed special waterproofing techniques. When the metal sheets are intended to be especially decorative rather than merely utilitarian, the expense is even greater. Frequently such decorative metal sheets may be formed of copper.

While metal roofing systems have not been superseded it has become relatively common to use, in their place, roofing systems in which the covering material is a flexible plastics material. Frequently the plastics material is ethylene propylene diene monomer (EPDM) rubber. Alternatively it maybe polyvinyl chloride (PVC). Either of these materials may be coloured either to mimic the colourings of natural metal roofing systems or in other colours that can only be achieved on metal by means of paint.

In one respect, metal sheeting may have some small advantage over the conventional use of plastic sheet in that metal sheeting may be provided with molded decorative ribs and grooves or other decorations. This type of decoration cannot conveniently be molded into flexible plastic sheeting in the same way as is possible for semi-rigid or rigid metal sheet. It is necessary to superimpose simulated decoration on roofs clad with plastic sheet.

The sheet may be applied to a roof subsurface, for example plywood, chipboard or other flat surface, by one of two conventional processes. The first of these is the mechanical fixing system in which the plastic sheet is laid over the subsurface and fixed around its edges by means of nails, screws, etc. The adjacent sheet overlaps the first sheet slightly and is similarly fixed around its edge or it may be welded or adhered to the edge of the first sheet. The second system is the fully adhered system in which the plastic sheet is adhered to the subsurface over its whole surface and is welded to the adjoining sheet at its edge to form a single integral sheet over the whole roof. While the mechanical fixing system and the fully adhered system may be regarded as equivalent, the fully adhered system may be preferable in that the resultant roof covering is totally waterproof and closely adhered to the subsurface so that there is no possibility of fluttering, or other movement of the sheet in high winds. This system, however, is not always possible, for example when using EPDM or other sheets which do not weld to one another and, therefore, various proposals have been made for waterproofing the joints between plastic sheets. These proposals generally are applicable to EPDM since there is little difficulty in welding PVC to form integral wholly waterproof sheets. Nevertheless, there is no reason why a mechanical fixing system may not be used with PVC if it is so desired.

Exemplary of a mechanical fixing system at the edge of sheets which is intended to provide both mechanical fixing and waterproofing and, possibly, some decorative ridging, is the system described and claimed in U.S. Pat. No. 5,168,684 issued Dec. 8, 1982 to Bruhm. The system described apparently includes longitudinal battens locating the respective edges of plastic sheets and disks holding the battens and sheet edges in place by means of fixing screws which pass right through the subsurface into a roof truss. Similarly U.S. Pat. No. 5,161,342 issued Nov. 10, 1992 to Hasan et al discloses simple battens and screws providing a mechanical fixing system for a plastic sheet. U.S. Pat. No. 4,833,853 discloses yet another mechanical fixing system in which an elongated mounting bracket through which a fixing screw extends, provides a grip for a cover member. The mounting bracket is of complex form and the edges of overlapping sheets are drawn up to cover the head of the screw. U.S. Pat. No. 4,389,826 issued Jun. 28, 1983 to Kelly shows another patent system for mechanical fixing of a flexible roofing sheet.

Exemplary of patents concerning semi-rigid or rigid roofing sheets are U.S. Pat. No. 4,366,465 issued Jan. 4, 1983 to Simpson and U.S. Pat. No. 4,269,012 issued May 26, 1981 Mattingly et al.

The present inventor has addressed the problem of providing a decorative finish strip for a flexible sheet roofing system irrespective of whether the roofing system is installed by the mechanical fixing method or by the fully adhered system. The present inventor has also addressed the problem of providing simplicity of installation with a minimum number of parts; the provision of a base strip which may be used for mounting a variety of different finish strips; and the need to keep the installation inexpensive by minimizing labour costs and part costs.

The mechanically fixed system requires a fastening bar or disc around the perimeter in the sheet or at any change in elevation or around protrusions. One of its main advantages is that it may be done at any time of year and is not dependent on the temperature at which the adhesive may be laid. The fully adhered system, on the other hand, can conform to any configuration but may be dependent upon temperature which influences the drying time of the adhesive.

SUMMARY OF THE INVENTION

According to the invention there is provided a roof cladding system comprising a flexible waterproof sheet for overlaying a supporting roof surface and a plurality of elongate feature strips to overlie the flexible waterproof sheet. Each of the feature strips comprises an elongate base member having a body attachable to the flexible waterproof sheet. Elongate lips of the body are oppositely upstanding at similar obtuse angles so that the elongate base member forms a shallow channel. Upper edges of the margins are spaced apart by a first distance which is greater than the width of the body. A snap-on cap for the body has elongate in-turned flanges, lower edges of which are spaced apart by a second distance which is less than the first distance. The in-turned flanges are resiliently deformable so that they may be biased apart so that the second distance increases to be greater than the first distance whereby the cap may be snapped over the body.

Between the flanges of the cap, a web of the cap which may have varying different PVC profiles to provide varying different decorative finishes to the roof surface. A cap having a web of one decorative finish may be replaced by another cap having a web of a different decorative finish by snapping off the first cap and replacing it with the other.

The base member may be attached to the flexible waterproof sheet by any convenient means for example by adhesive or by nails or screws which pass through the flexible waterproof sheet into the supporting roof surface. These nails or screws may be thin, light duty nails or screws since their primary purpose is only to hold the feature strip in position. Thus, any puncture of the flexible waterproof sheet by the nails or screws is very small. Nevertheless, when nails or screws are used, it is considered desirable to utilize an adhesive or sealant in addition.

The statement that light weight nails or screws are used, is not intended to preclude the use of heavy duty nails or screws which may fulfil the secondary purpose of providing mechanical fixing around the edges of the flexible sheet. Nevertheless, it is to be emphasized that if the nails or screws intended to hold the feature strips in position fulfil the purpose of mechanically fixing the flexible sheet also, such mechanical fixing of the flexible sheet is only ancillary to the present invention.

The invention also includes within its scope a method of cladding a roof, comprising laying a flexible waterproof sheet over a supporting roof surface and applying thereover a plurality of the elongate feature strips according to the invention.

The flexible waterproof sheet may be any flexible waterproof sheet conventionally used for roofing systems for example, ethylene diene propylene monomer, chlorosulphonated polyethylene, chlorinated polyethylene, ethylene interpolymers, propylene interpolymers, butadiene-acrylonitrile polymer and ethylene propylene polymer. Conveniently it may be PVC sheet or PVC sheet reinforced with non-wicking woven fabric which is suitable for application by the full adhering system i.e. by gluing down over its full surface. Whether the sheet is applied by the full adhering system or the mechanical fixing system, the edges of one sheet may be welded to the edges of the next sheet if the sheet is a plastics material suitable for such welding.

The material of the cap of the feature member may be molded from PVC of a rigidity sufficient to give it the necessary deformability. The cap must be a sufficiently tight fit over the base member so that it does not easily detach therefrom but its flanges should be biasable apart in order that it snaps easily over the base member in installation.

The material of the base member may be any suitable material having a rigidity in its margins sufficient to hold the flanges of the cap securely. Conveniently, the body may also be made from PVC for consistency. There is, however, no reason why the body should not be made from a metal strip or other material strip especially when it is fixed to the flexible waterproof sheet by means of nails or screws there through fixing it with respect to the supporting roof surface.

BRIEF DESCRIPTION OF THE DRAWINGS

The invention will now be described by way of example with reference to the drawings, in which.

DETAILED DESCRIPTION OF A PREFERRED EMBODIMENT

Figure 1:
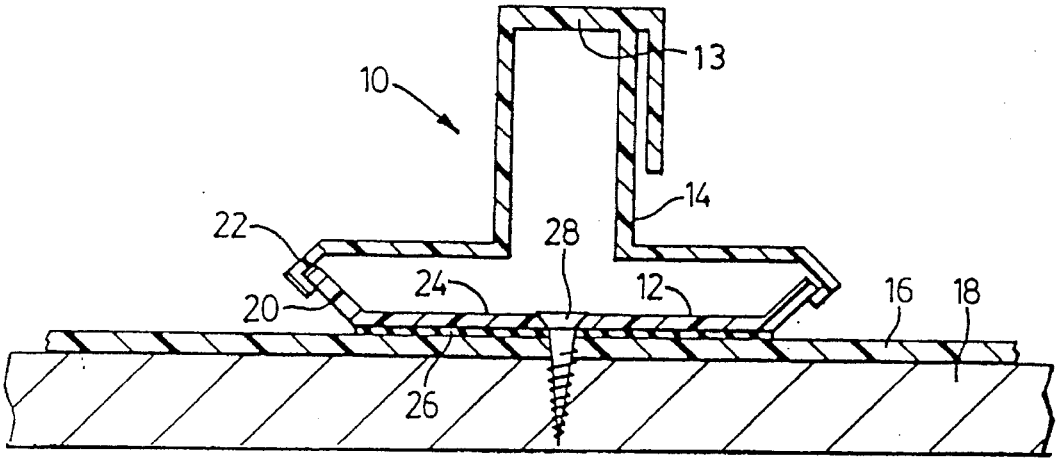
FIG. 1 is a section of a roof cladding system according to invention.
Figure 3:
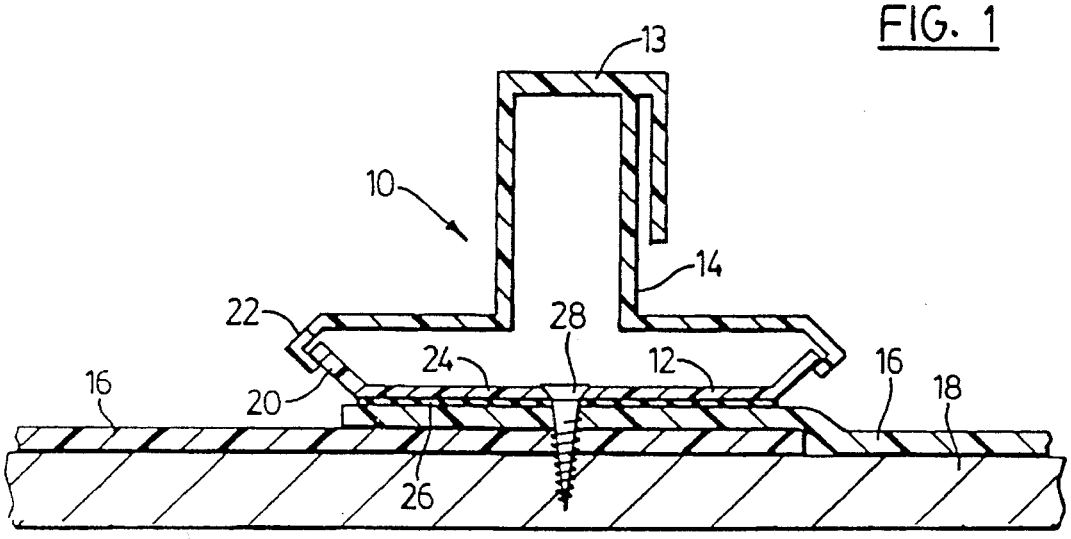
FIG. 3 is a section similar to that of FIG. 1 in which the feature strip covers a join in the underlying waterproof flexible roofing sheet.
Figure 4:
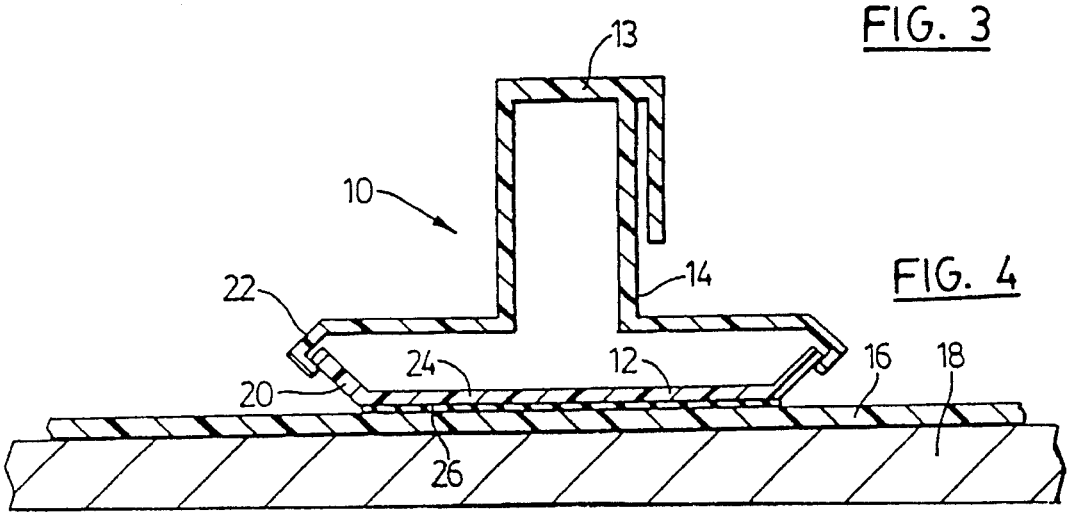
FIG. 4 shows a section through a different embodiment where the feature strip is attached to the flexible sheet through the use of adhesive alone.
Figure 2:
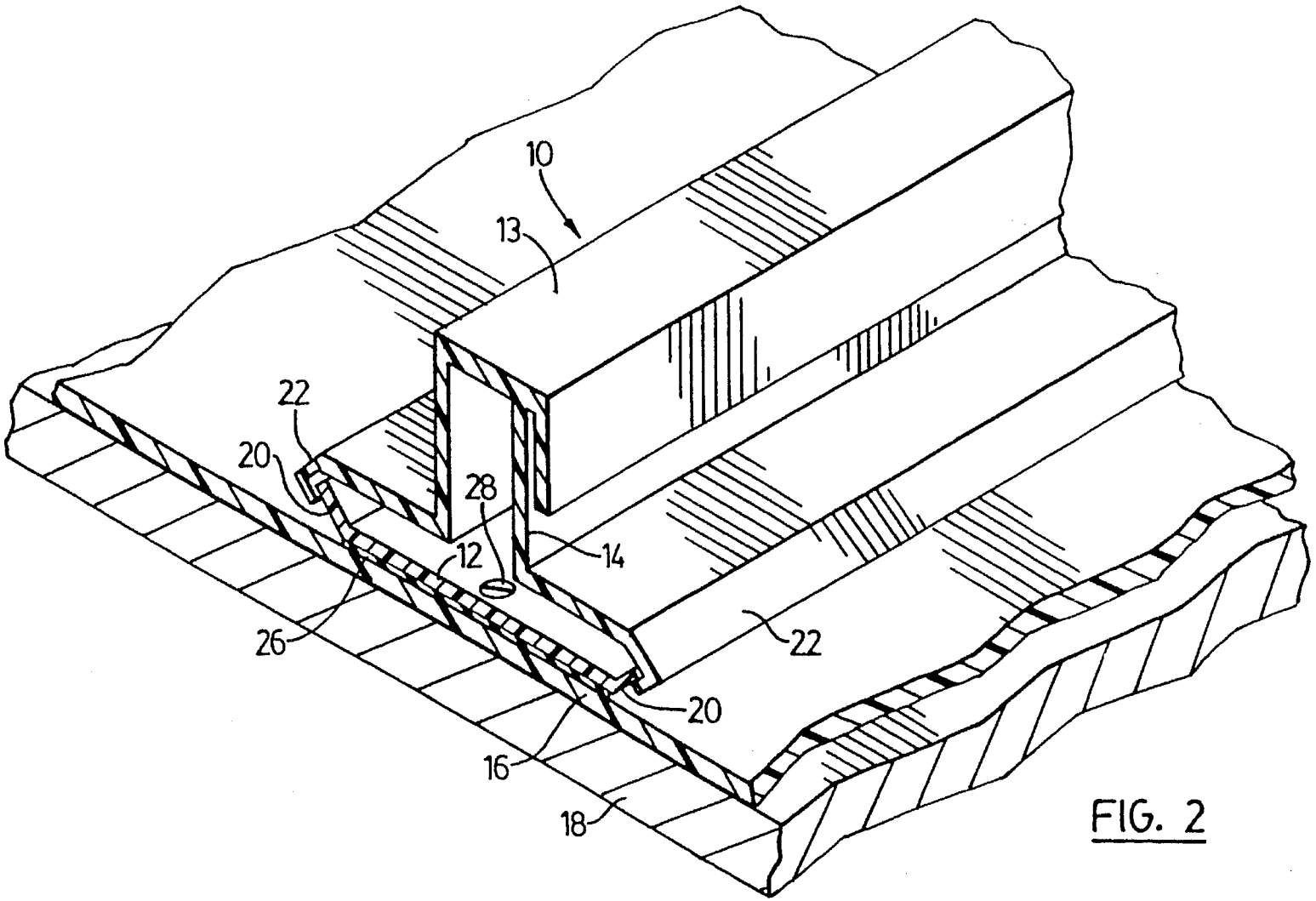
FIG. 2 is an illustrative perspective view of a roof cladding system as shown in FIG. 1.

The drawings all show embodiments of the invention in which a feature strip 10 comprises a base strip 12 and a cap 14. Where possible similar numerals will be used for similar parts in each of the drawings. Only where differences in design necessitate the use of different reference numerals will they be used.

Feature strips 10 according to the invention may be laid over flexible plastics material roofing sheet 16 which itself is laid on top of a roof subsurface 18.

The flexible, plastics material, roofing sheet may be any of those materials conventionally used for this purpose but, conveniently, may be polyvinyl chloride (PVC) possibly reinforced with a non-wicking woven fabric of, for example, fibreglass or polyester, since this material is suitable for use for both fully adhered and mechanically fixed systems. Other suitable materials are, for example, ethylene propylene diene monomer (EPDM) polyethylene and substituted polyethylenes, neoprene, polypropylene, polybutene, and the like.

The roofing subsurface may be a top surface of plywood, chipboard or specialist rigid sheet materials which are used in the building industry. This sheet material is laid on the roof joists (not shown) and fixed thereto.

It is immaterial as to the manner in which the flexible sheet material 16 is laid on the subsurface 18. Thus, it may be laid by the fully adhered method in which the whole undersurface of the flexible sheet 18 is adhered to the subsurface 18 or it may be laid by the mechanically fixed method in which the edges of each sheet are fixed by means of bolts, screws, nails, or other mechanical fixing means with or without adhesive.

Whatever the manner of fixing the sheet it may be convenient, when the sheet is PVC, or other weldable material, that the edges of adjoining sheet sections be welded together.

Once the sheet 16 is in place over subsurface 18 feature strips may be overlaid on it to break up the universally flat surface provided by the sheet 16. The feature strips 10 may also cover any visible joins between sections of the sheet 16.

Figure 5:
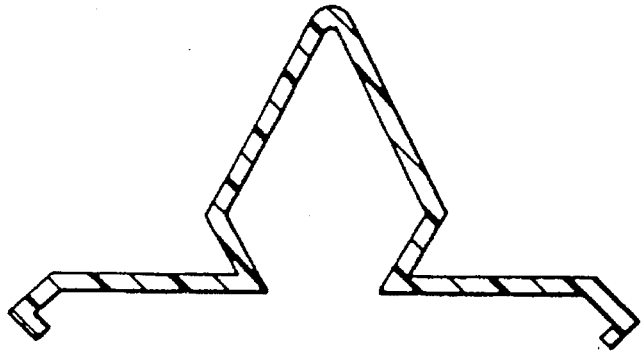
FIG. 5 to 7 show different caps for feature strips of the invention having different ornamental profiles.
Figure 6:
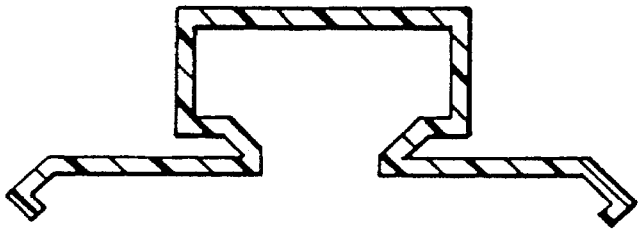
Figure 7:
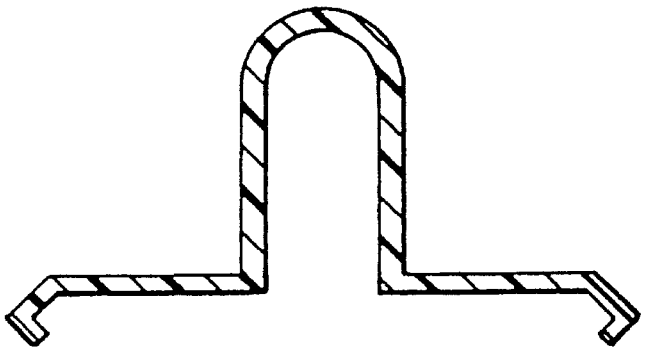

Each feature strip 10 comprises an elongate base member 12 and an elongate cap 14 which snaps over the base member. The cap 14 may have an upstanding profile of any desired shape and size. Thus, the profile 13 of the cap 14 may mimic various conventional profiles of standing seams such as those shown in FIGS. 5 to 7. The profile of cap 14 is, however, not limited to mimic standing seams whose shape was originally dictated by the interfolding of adjoining metal edges for waterproofing reasons, but the profile of cap 14 may have any desired decorative or ornamental shape.

Insofar as the present invention is concerned it is only necessary that base member 12 and cap 14 should be engagable one with the other by snap together engagement. As illustrated, snap together engagement means are provided by up-turned lips 20 of base member 12 forming lips which act as latches for downwardly in-turned flanges 22 of cap 14. Thus, base member 12 may comprise a body 24 which is a flat strip which may be attached to the flexible sheet 16 by any convenient means such as by adhesive 26 or by nails 28 or screws, or, as shown in FIG. 1, by a combination of nails 28 and adhesive 26. It is to be noted that the nails 28 which are illustrated are light weight nails and do not extend deeply into roof subsurface 18. Punctures of the flexible sheet 16 will be small and will be fully sealed by adhesive sealant 26.

Again, as illustrated, up-turned side lips 20 of base member 12 rise slightly from body 24 of base member 12 such that flanges 22 of cap 14 may hook under them. Base member 12 therefore is in the form of a shallow channel between lips 20.

Cap 14 is made of resilient deformable material and its downwardly in-turned flanges 22 may be manually biased apart so that the cap may be snapped over lips 20 of base member 12.

When the profile 13 of cap 14 is narrow in width as is shown in FIG. 1, the downwardly in-turned flanges 22 may be provided on outwardly directed cover portions 15 of cap 14 which lie parallel to the body 24 of base member 12. The profile 13 and cover portions 15 together make up a web of the cap extending between flanges 22.

Although, a base member 12 with a narrow body 24 may be provided to cooperate with a cap 14 having a narrow profile 13 and a different base member 12 having a wide body 24 may be provided for a wide profiled cap 14, it is believed that it will be convenient to provide base members 12 of a single standard width to minimize the parts necessary for a roofing system having interchangeable caps. Caps 14 which are provided with downwardly projecting in-turned flanges 22 which are set to engage the upwardly extending margins of base member 12 irrespective of the width of the cap profile. Thus, one cap 14 may be interchanged for another.

The downwardly extending in-turned flanges 22 of cap 14 may be in the form of hooks so that they curl over and under the edges of lips 20 of base member 12. The cap may, therefore, also act to protect the base member and the head of any nails or screws 28 from precipitation, such as rain, sleet or snow.

Profile 13 may be of general U-shape having downwardly extending members 30 and a top portion 32 extending between members 30. Any additional projections 34 may enhance decorative effects. It may be advantageous that, as shown, the cover portions 15 are not connected one with the other except through each leg 30 of profile 13. When the cover portions are connected only through the U-shaped profile it may be possible to gain a greater degree of resilient deformability than is possible if the cover portions are joined to one another beneath the profile 13. Nevertheless, where the material of the cap 14 is suitable it is entirely possible that the cover portions are integral one with the other extending across the whole width of base member 12 between the flanges 22. In this case, the profile 13 may possibly be entirely missing so that the appearance of the feature strip is very discreet, such as that of a simple batten.

The base member 12 may be molded or cast from any suitable material and it is envisaged that, in some circumstances the base member may be metal. It is, however, probable that the base member will be molded from any suitable plastics material which has sufficient rigidity for the upturned lips 20 to act as latches for the downwardly, in-turned flanges 22 of the cap. Very suitably, the upturned lips 20 will extend outwardly at an obtuse angle to the body 24 of base member 12 so that they extend outwardly over the flexible sheet 16 at acute angles to it. The margins should not extend upwardly so far so that the lips they present become unsightly.

Although the feature strip may be made in many different dimensions, the proportions may be, for example, roughly in conformity with the following exemplary dimensions. For a feature strip having a profile upstanding from the cover portions 15 in an amount of, say, ⅞ to 1¼ inches, the lips of the base member may upstand from the flexible roofing sheet 16 by about ⅜ inch. The width of the margins themselves may be in the region of a ¼ inch while the width of the body might be generally in the region of 2 inches.

Conveniently the base member may also be made from polyvinyl chloride.

The cap may be made out of any suitable resiliently deformable material such as polyvinyl chloride or other plastics material or a metal such as aluminum. The cap may be made by extrusion or by molding techniques.

Installation of the system comprises first installing the plastics roofing sheet over the subsurface 18. Base members 12 are then installed in the desired positions by means of adhesive 26 and nails 28. After installation of the base member 12, it may be a simple matter to manually snap a cap 14 of chosen profile over the base members.

I claim:

1. A roof cladding system comprising a flexible waterproof sheet for overlaying a supporting roof surface; and a plurality of elongate feature strips to cover said flexible waterproof sheet;

each one of the feature strips comprising:

an elongate base member having a body attachable to said flexible waterproof sheet and elongate lips oppositely upstanding from the body at similar obtuse angle thereto similar upper edges thereof being spaced apart by a first distance greater than the width of the body and a snap-on elongate cap comprising a cover for the base member, the cover comprising a pair of cover portions spaced apart from each other and each extending oppositely from one another from a lower end of a U-shaped cap profile which forms part of the cover, each cover portion having an elongate in-turned flange depending from the cover, lower edges of the flanges being spaced apart by a second distance less than the first distance, the in-turned flanges being resiliently deformable so that they may be biased apart such that the second distance increases to greater than the first distance whereby the cap may be snapped over the elongate lips of the body.

2. A roof cladding system as claimed in claim 1 in which the flexible waterproof sheet comprises polyvinyl chloride.

3. A roof cladding system as claimed in claim 2 in which the flexible waterproof sheet is polyvinyl chloride reinforced with a non-wicking woven fabric.

4. A roof cladding system as claimed in claim 3 in which the flexible waterproof sheet is polyvinyl chloride reinforced with a non-wicking woven fabric made of fibre glass or polyester.

5. A roof cladding system as claimed in claim 1 in which the snap-on cap is interchangeable with other snap-on caps of different profile.

6. A roof cladding system as claimed in claim 1 in which the cover is formed from polyvinyl chloride.

7. A roof cladding system as claimed in claim 1 in which the base member is formed from polyvinyl chloride.

* * * * *